US007478538B2

(12) United States Patent
Manole et al.

(10) Patent No.: US 7,478,538 B2
(45) Date of Patent: Jan. 20, 2009

(54) REFRIGERANT CONTAINMENT VESSEL WITH THERMAL INERTIA AND METHOD OF USE

(75) Inventors: Dan M Manole, Tecumseh, MI (US); Rick L Bunch, Tecumseh, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 516 days.

(21) Appl. No.: 11/197,687

(22) Filed: Aug. 4, 2005

(65) Prior Publication Data

US 2006/0086108 A1 Apr. 27, 2006

Related U.S. Application Data

(60) Provisional application No. 60/621,025, filed on Oct. 21, 2004.

(51) Int. Cl.
*F25B 43/00* (2006.01)
*F25B 43/02* (2006.01)
*F25B 45/00* (2006.01)

(52) U.S. Cl. ..... 62/149; 62/471; 62/503

(58) Field of Classification Search ..... 62/149, 62/503, 512, 513, 471, 83
See application file for complete search history.

(56) References Cited

U.S. PATENT DOCUMENTS

| | | | | |
|---|---|---|---|---|
| 2,133,960 | A | 10/1938 | McCloy | 62/213 |
| 4,537,045 | A | 8/1985 | Mayer | 62/503 |
| 5,075,967 | A | 12/1991 | Bottum | 29/890.06 |
| 5,076,066 | A | 12/1991 | Bottum | 62/126 |
| 5,167,128 | A | 12/1992 | Bottum | 62/174 |
| 5,497,631 | A | 3/1996 | Lorentzen et al. | 62/115 |
| 5,551,255 | A | 9/1996 | Rothfleisch | 62/502 |
| 5,722,146 | A | 3/1998 | Seigle et al. | 29/446 |
| 5,868,001 | A * | 2/1999 | Shoulders | 62/503 |
| 5,996,372 | A | 12/1999 | Koda et al. | 62/503 |
| 6,042,342 | A | 3/2000 | Orian | 417/207 |
| 6,463,757 | B1 | 10/2002 | Dickson et al. | 62/503 |
| 6,467,300 | B1 | 10/2002 | Noble, III | 62/472 |
| 6,523,365 | B2 | 2/2003 | Zhang et al. | 62/503 |
| 6,612,128 | B2 | 9/2003 | Dickson et al. | 62/471 |
| 6,615,609 | B2 | 9/2003 | Kawasaki et al. | 62/503 |
| 2002/0078702 | A1 | 6/2002 | Makizono et al. | 62/271 |
| 2003/0046944 | A1 | 3/2003 | Kitamura et al. | 62/227 |

* cited by examiner

*Primary Examiner*—Chen-Wen Jiang
(74) *Attorney, Agent, or Firm*—Baker & Daniels LLP

(57) ABSTRACT

A vapor compression system including a closed fluid circuit having operably coupled thereto, in serial order, a compressor, a first heat exchanger, an expansion device, a second heat exchanger and a fluid vessel. The refrigerant is compressed in the compressor and circulated through the fluid circuit. Thermal energy is removed from the refrigerant in the first heat exchanger. The pressure of the refrigerant is reduced in the expansion device, and thermal energy is added to the refrigerant in the second heat exchanger. Upon ceasing operation of the system, refrigerant present in the vessel defines a lower temperature than the refrigerant present in the second heat exchanger. A thermal energy storage medium is operably coupled to the vessel and provides the vessel with thermal inertia wherein the temperature of the refrigerant in the vessel remains cooler than the temperature of the refrigerant in the second heat exchanger.

21 Claims, 3 Drawing Sheets

REFRIGERANT CONTAINMENT VESSEL WITH THERMAL INERTIA AND METHOD OF USE

CROSS REFERENCE TO RELATED APPLICATION

This application is related to and claims the benefit under 35 U.S.C. §119(e) of U.S. Provisional Patent Application Ser. No. 60/621,025, filed Oct. 21, 2004.

BACKGROUND OF THE INVENTION

1. Field of the Invention

The present invention relates to vapor compression systems for refrigerants, more particularly to fluid containment vessels in such vapor compression systems.

2. Description of the Related Art

Refrigeration systems typically include, in series, a compressor, a condenser, an expansion device, and an evaporator. In operation, gas phase refrigerant is drawn into the compressor where it is compressed to a high pressure. The high pressure refrigerant is then cooled and condensed to a liquid phase in the condenser. The pressure of the liquid phase refrigerant is then reduced by the expansion device. In the evaporator the low pressure liquid phase refrigerant absorbs heat and converts the low pressure liquid phase refrigerant back to a gas. The gas phase refrigerant then returns to the compressor and the cycle is repeated.

Compressors are typically designed for the compression of gas phase refrigerant, however, it is possible for a certain amount of liquid phase refrigerant to flow from the evaporator toward the compressor. For instance, when the system shuts down condensed refrigerant may be drawn into the compressor from the evaporator, thereby flooding the compressor with liquid phase refrigerant. When the system is restarted, the liquid phase refrigerant within the compressor can cause abnormally high pressures within the compressor and can thereby result in damage to the compressor. To prevent this phenomenon from occurring, it is known to use suction accumulators in the refrigeration system in the suction line of the compressor.

Commonly used suction accumulators are mounted near the suction inlet of the compressor and separate liquid and gas phase refrigerant. As the refrigerant flows into the accumulator, the liquid phase refrigerant collects at the bottom of the storage vessel, while the gas phase refrigerant flows through the storage vessel to the compressor. Typically, a metered orifice is provided in the lower portion of the vessel to dispense a small amount of the collected liquid phase refrigerant to the compressor, thereby preventing large amounts of potentially harmful liquid phase refrigerant from entering the compressor.

When the system is shutdown, thermal energy is transferred from the ambient environment to the refrigerant in both accumulator and the evaporator, thereby warming the refrigerant therein. Because the evaporator comprises a large mass of metal and ice often accumulates on the evaporator surface, the evaporator tends to warm up more slowly than the accumulator. The refrigerant has a natural tendency to migrate to the coolest area of the system, when not subjected to suction pressure and, therefore, the refrigerant is attracted to and naturally migrates to the evaporator. However, the heat exchangers of a refrigeration system, including the evaporator and condenser, typically comprise many folds or joints. These joints are more vulnerable to developing leaks relative to components not having joints. Accordingly, when leaks occur in the system, they most commonly occur in either the evaporator or the condenser. It would be beneficial to trap the refrigerant in a special storage vessel during shutdown to thereby contain the refrigerant, prevent it from migrating to the evaporator and minimize the possibility of leaks.

SUMMARY OF THE INVENTION

The present invention provides a vapor compression system having a fluid storage vessel with thermal inertia. The vapor compression system comprises, in one form thereof, a closed fluid circuit having operably coupled thereto, in serial order, a compressor, a first heat exchanger, an expansion device, a second heat exchanger and a fluid vessel. During operation of the vapor compression system the refrigerant is compressed in the compressor and circulated through the fluid circuit. Thermal energy is removed from the refrigerant in the first heat exchanger. The pressure of the refrigerant is reduced in the expansion device, and thermal energy is added to the refrigerant in the second heat exchanger. Upon ceasing operation of the system, liquid phase refrigerant present in the second heat exchanger defines a first temperature and liquid phase refrigerant present in the fluid vessel defines a second temperature. The second temperature is lower than the first temperature, and each of the first and second temperatures is less than a temperature of the ambient environment. A thermal energy storage medium is operably coupled to the fluid vessel such that upon ceasing operation of the system, the thermal energy storage medium provides the fluid vessel with thermal inertia wherein the second temperature remains cooler than the first temperature as the refrigerant in the second heat exchanger and the refrigerant in the fluid vessel both acquire thermal energy from the ambient environment. The refrigerant is attracted to the fluid vessel whereby the mass of refrigerant contained within the fluid vessel increases upon ceasing operation of the system.

The present invention also provides a method of storing refrigerant in a vapor compression system. The vapor compression system includes a closed fluid circuit having operably coupled thereto, in serial order, a compressor, a first heat exchanger, an expansion device, and a second heat exchanger. The method includes operably disposing a fluid vessel in the fluid circuit at a location between the second heat exchanger and the compressor, actively circulating a refrigerant through the fluid circuit wherein thermal energy is removed from the refrigerant in the first heat exchanger and thermal energy being added to the refrigerant in the second heat exchanger, ceasing the active circulation of the refrigerant through the fluid circuit, and attracting refrigerant within the fluid circuit to the fluid vessel after ceasing the active circulation of the refrigerant through the system. The mass of refrigerant within the fluid vessel after ceasing the active circulation of the refrigerant through the system is greater than the mass of refrigerant within the fluid vessel immediately preceding the ceasing of the active circulation of the refrigerant through the system.

An advantage of the present invention is that the flammable refrigerant fluid can be contained within the vessel where it is isolated from heat and air. In addition, the flammable refrigerant fluid can be trapped in the vessel when a leak in the system is detected.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
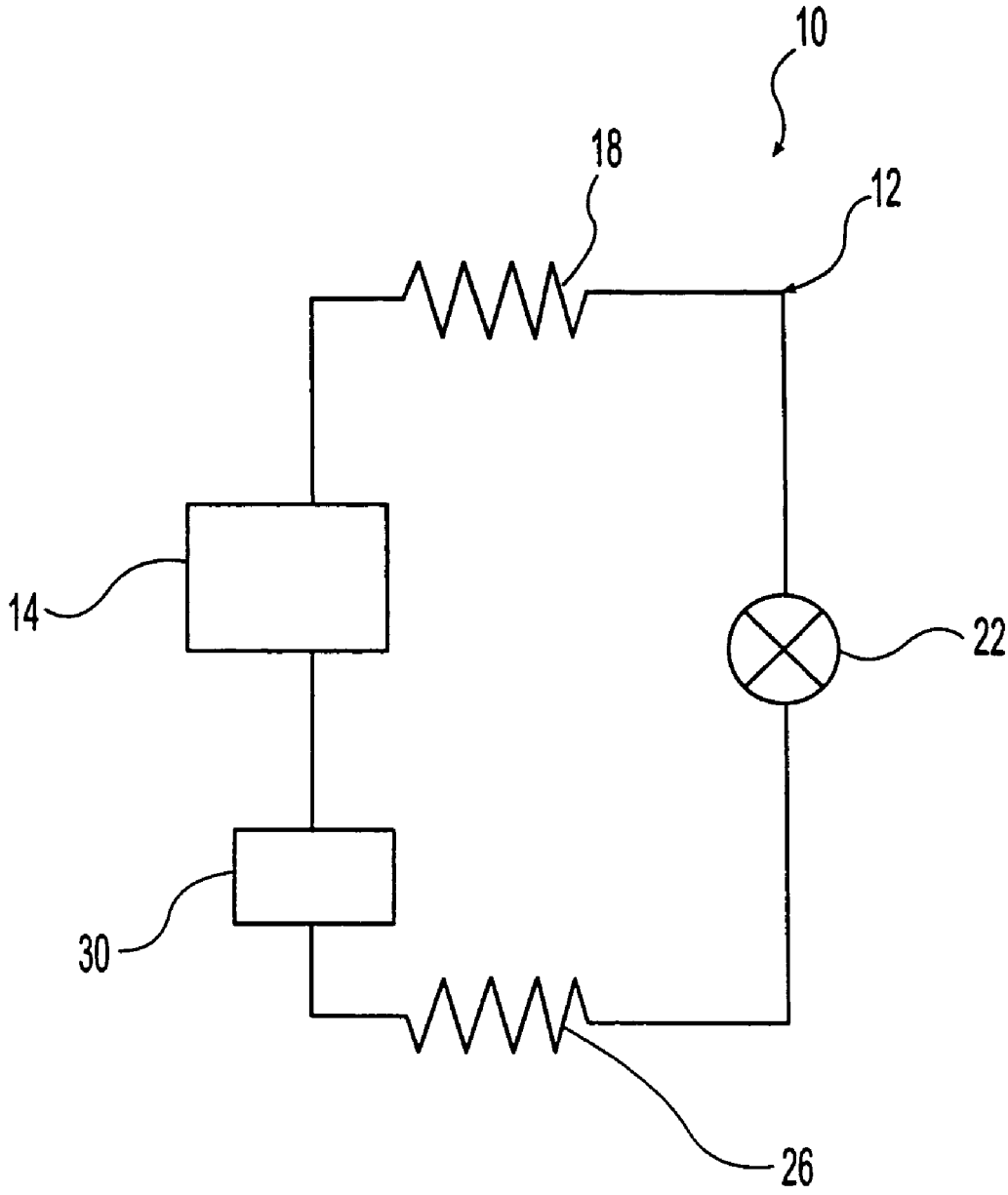
FIG. 1 is a diagrammatic view of a closed fluid circuit of a vapor compression system in accordance with the present invention.

Corresponding reference characters indicate corresponding parts throughout the several views. Although the exemplification set out herein illustrates an embodiment of the invention, in one several form, the embodiment disclosed below is not intended to be exhaustive or to be construed as limiting the scope of the invention to the precise form disclosed.

DESCRIPTION OF THE PRESENT INVENTION

Referring first to FIG. 1, vapor compression system 10 includes closed fluid circuit 12, through which flows a compressible refrigerant fluid such as $CO_2$, a hydrocarbon refrigerant, e.g. propane, or other suitable refrigerant. Operably coupled to the circuit in serial order is compressor 14, first heat exchanger 18, expansion valve 22, second heat exchanger 26 and fluid containment vessel or accumulator 30. In general operation, refrigerant vapor fluid is drawn by suction pressure into compressor 14 where the refrigerant fluid is compressed. The resulting hot compressed fluid then flows through circuit 12 to first heat exchanger 18. First heat exchanger 18 acts as a condenser, wherein thermal energy is removed from the refrigerant, thereby cooling the compressed refrigerant. The cooled compressed refrigerant then flows through circuit 12 to expansion device 22, which reduces the pressure of the compressed refrigerant and meters the compressed fluid to second heat exchanger 26. Second heat exchanger 26 acts as an evaporator, wherein thermal energy is transferred from the ambient air surrounding second heat exchanger 26 to the refrigerant, thereby cooling the ambient air. The refrigerant then flows through circuit 12 to fluid storage vessel 30, which stores liquid refrigerant and releases refrigerant at a controlled rate to compressor 14. The details of fluid storage vessel 30 and its operation are disclosed in further detail below.

Generally, upon ceasing operation of compression system 10, the refrigerant present in second heat exchanger 26 defines a first temperature, while the refrigerant present in fluid storage vessel 30 defines a second temperature. During system shutdown, thermal energy is transferred from the ambient environment to the refrigerant in both fluid storage vessel 30 and second heat exchanger 26, thereby warming the refrigerant therein. Also, during system shutdown the refrigerant is no longer subject to suction pressure and, therefore, the refrigerant is attracted to and naturally migrates to the coolest area of the system 10. It is desirable to trap the refrigerant in fluid storage vessel 30 during shutdown to thereby contain the refrigerant and minimize and prevent possible leaks. Thus, as is further described below, storage vessel 30 is adapted to restrict the transfer of heat between the ambient air and the refrigerant within fluid storage vessel 30 during shutdown such that the second temperature of the refrigerant within fluid storage vessel 30 is lower than the first temperature of the refrigerant within second heat exchanger 26, thereby causing the refrigerant to naturally migrate to storage vessel 30.

Turning now to FIGS. 2A-2D, fluid storage vessel 30 includes sealed casing 34 which defines interior space 38. Casing 34 may be thermally insulated with an insulating material (not shown) to inhibit the thermal transfer of energy from the ambient air to the refrigerant within interior space 38. Casing 34 defines inlet port 42, which is operably disposed in fluid circuit 12 between second heat exchanger 26 and interior space 38 and which provides fluid communication between fluid circuit 12 and interior space 38. Casing 34 also defines outlet port 46, which is operably disposed in fluid circuit 12 between interior space 38 and compressor 14 and which provides fluid communication between interior space 38 and fluid circuit 12.

Thermal energy storage medium 50 is disposed in interior space 38 and is adapted to maintain the cool temperature of the refrigerant fluid within fluid storage vessel 30 and resist the thermal transfer of energy from the ambient environment to the refrigerant within interior space 38 during shutdown. Thermal energy storage medium 50 may be constructed of any material having a relatively high thermal inertia. In other words, the material should be capable of storing heat and should have a tendency to resist changes in temperature. Such materials will resist the transfer of heat from the ambient environment to the refrigerant within the fluid storage vessel 30. Acceptable high thermal inertia materials may include cast iron and brass that have at least 45 $Btu/ft^3 \cdot °F$. heat capacity.

Thermal control body 54 is disposed within interior space 38. Thermal control body 54 may be a solid or hollow body and may be constructed of any rigid material having a bouyancy in refrigerant fluid. Thermal control body 54 cooperates with casing 34 and outlet 46 to define a variable storage volume within fluid storage vessel 30. More particularly, as storage control body 54 moves downward within interior space 38, it increasingly displaces liquid refrigerant, thereby decreasing the variable storage volume as illustrated in FIGS. 2A-2D. The upward and downward movement of storage control body 54 is affected by a balance of forces. First, storage control body 54 is suspended from the upper portion of casing 34 by spring 58 which exerts an upward spring force on storage control body 54. Second, storage control body 54 is buoyant in the liquid refrigerant and, therefore, the liquid refrigerant exerts an upward buoyant force on storage control body 54. In addition, gravity provides a downward force against storage control body 54. A further downward force on storage control body 54 is provided by an electromagnetic field generated by magnet 68. A first closure device 62 is disposed within interior space 38 and is operatively engaged to storage control body 54. A second closure device 64 is also disposed within interior space 38 and is operatively engaged to storage control body 54. As is described in further detail below, first and second closure devices 62, 64 are adapted to open and close inlet and outlet parts 42, 46, respectively, in response to the movement of storage control body 54.

Beginning with FIG. 2A, the operation of fluid storage vessel 30, including storage control body 54, will now be described. Before initial start-up of compression system 10, electromagnets 68 are off and the magnetic force acting on storage control body 54 is zero. Storage control body 54 and spring 58 are configured such that the balance of the remaining forces (gravitational, spring and buoyant forces) acting on storage control body 54 places storage control body 54 in the closed position shown in FIG. 2A when the magnetic force is zero. In this position, both first and second closure devices 62, 64 are in a closed position, thereby sealingly blocking inlet and outlet ports 42, 46, respectively. In this position, fluid communication of refrigerant 70 through inlet and outlet ports 42, 46 is blocked. As a result, the refrigerant remains trapped in storage vessel 30, thereby containing refrigerant 70 and minimizing leaks from other areas of circuit 12.

Figure 2B:
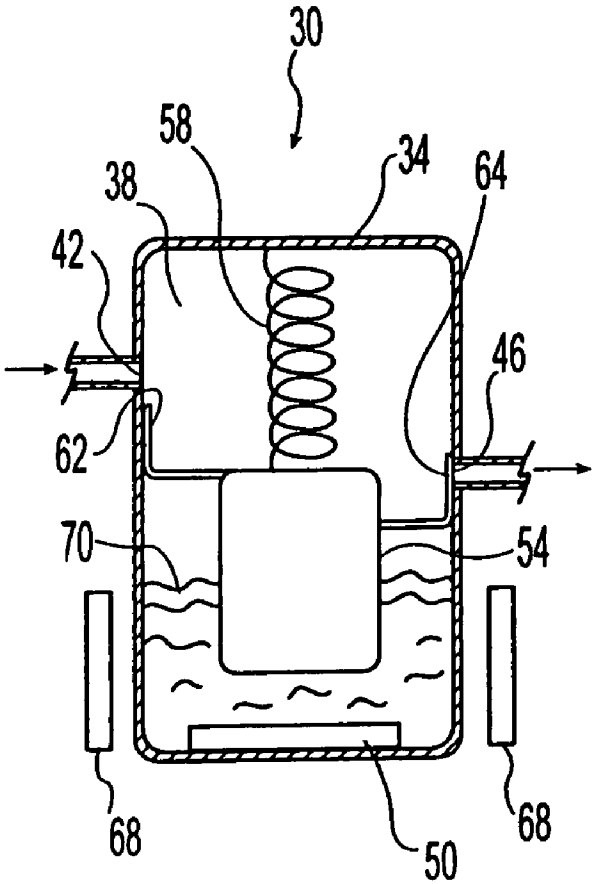
FIG. 2B is a sectional view of the fluid storage vessel of FIG. 2A in a second position.
Figure 2A:
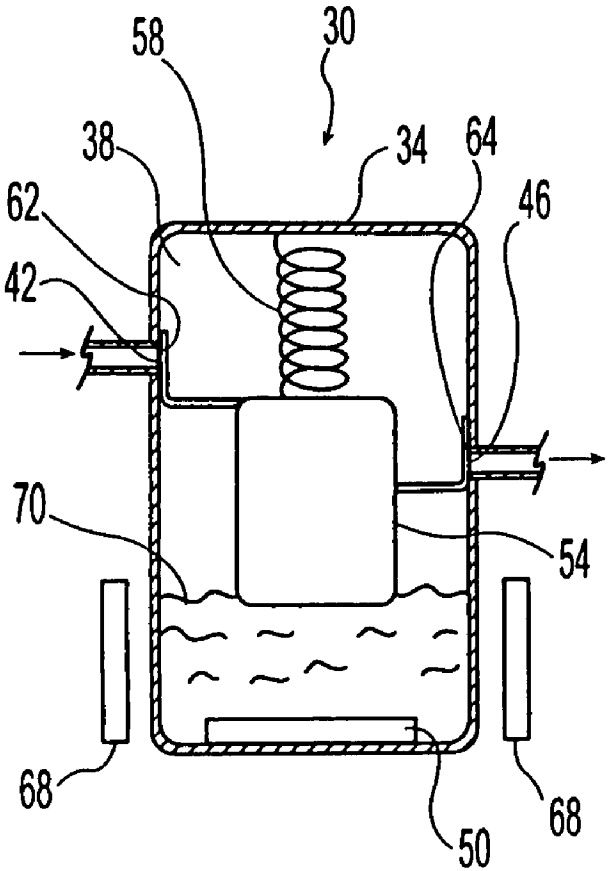
FIG. 2A is a sectional view of a fluid storage vessel in a first position in accordance with one embodiment of the present invention.

Referring now to FIG. 2B, once compression system 10 is started, electromagnets 68 generate an electromagnetic field which pulls storage control body 54 downward. As storage control body 54 moves downward, liquid refrigerant 70 is displaced, thus, raising the level of refrigerant 70. In addition, as storage control body 54 moves downward, it moves first and second closure devices 62, 64 away from inlet and outlet ports 42, 46, respectively, to an open position as shown in FIG. 2C. In this open position liquid refrigerant 70 and refrigerant vapor may be communicated through inlet and outlet ports 42, 46.

It may be desirable to open inlet and outlet ports 42, 46 independently at different times. Accordingly, as shown in FIGS. 2A-2C, first and second closure devices are engaged to storage control body 54 at different elevational positions and inlet and outlet ports 42, 46 are defined in casing 34 at different elevational positions. As a result, as storage control body 54 moves downward, first closure device 62 reaches its open position before second closure device, as shown in FIG. 2B, thereby opening inlet port 42 before opening outlet port 46 and allowing refrigerant to flow into interior space 38. As storage control body 54 continues to move further downward, second closure device is moved to its open position, as shown in FIG. 2C, thereby allowing refrigerant to flow from interior space 38 through outlet port 46 to circuit 12. The time between the opening of inlet and outlet ports 42, 46 may be controlled by adjusting the speed at which storage control body 54 is pulled downward. This may be adjusted by controlling the strength of the electromagnetic field and the force it exerts on storage control body 54. Alternatively, the time between the opening of inlet and outlet ports 42, 46 may be determined by adjusting the size and/or location of first and/or second closure devices 62, 64.

Figure 2D:
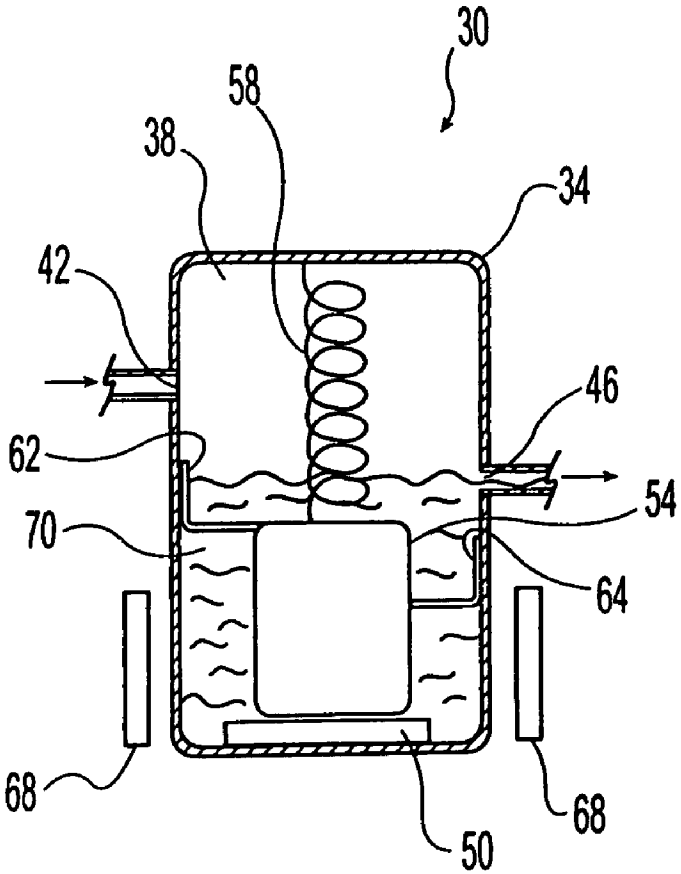
FIG. 2D is a sectional view of the fluid storage vessel of FIG. 2A in a fourth position.
Figure 2C:
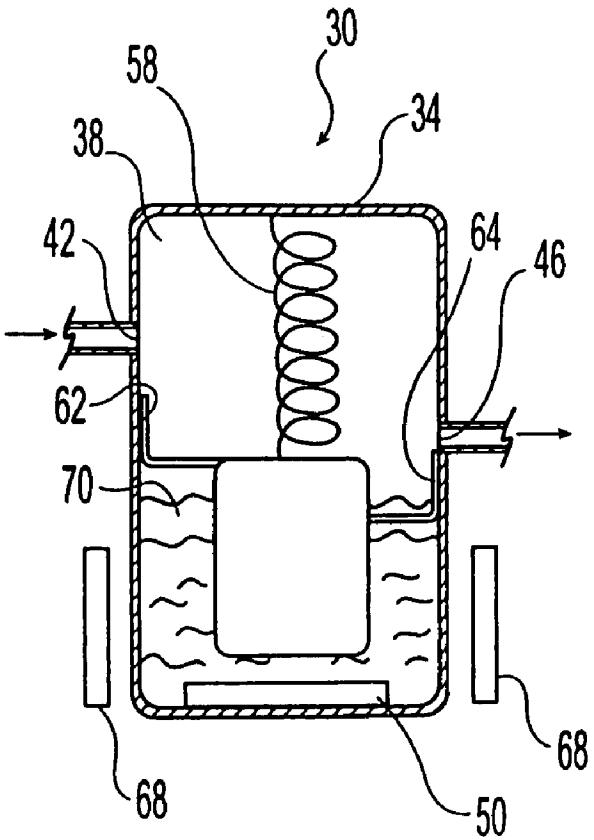
FIG. 2C is a sectional view of the fluid storage vessel of FIG. 2A in a third position.

Referring to FIG. 2D, the electromagnetic force continues to pull storage control body 54 downward below the level of liquid refrigerant 70, thereby further displacing liquid refrigerant 70 and further raising the level of liquid refrigerant 70 to outlet port 46. As a result, liquid refrigerant is dispensed from interior space 38 through outlet port 46 and into circuit 12. As shown in FIG. 2D, inlet port 42 is defined in casing 34 at a higher elevational position than outlet port 46 to thereby prevent liquid refrigerant 70 from exiting interior space 38 through inlet port 42.

When system 10 is shut down, the electromagnets are also shut down, thus dropping the magnetic force to zero. When the magnetic force drops to zero, the spring and buoyant forces pull storage control body 54 upward as shown in FIG. 2C. The spring and buoyant forces continue to pull control body 54 upward causing second closure device 64 to block outlet port 46 as shown in FIG. 2B, thereby preventing liquid refrigerant 70 from exiting interior space 38 through outlet port 46.

Meanwhile, after shutdown, the components of compression system 10 start warming up due to a transfer of heat from the ambient environment. Thermal energy storage medium 50, along with any insulation in casing 34, provides fluid storage vessel 30 with thermal inertia such that the refrigerant in vessel 30 resists changes in temperatures and the transfer of heat from the ambient environment. Consequently, the refrigerant within fluid storage vessel 30 heats up more slowly than the refrigerant in other components and areas of circuit 12, and has a tendency to remain cooler for a longer period of time. As a result, following shutdown, the second temperature of the refrigerant in vessel 30 remains lower than the first temperature of the refrigerant in heat exchanger 26, and the refrigerant is thus attracted to the cooler storage vessel 30. The refrigerant in circuit 12 migrates to fluid storage vessel 30 and enters interior space 38 through inlet port 42. As the level of liquid refrigerant 70 increases, the buoyant force pushes storage control body 54 further upward until both first and second closure devices 62, 64 are blocking respective inlet and outlet ports 42, 46, as shown in FIG. 2A. In this position, refrigerant fluid 70 is trapped in interior space 38 and cannot exit through inlet port 42 or outlet port 46. Storage vessel 30 may be configured such that the timing between the closures of inlet and outlet ports 42, 46 is commensurate with a predefined time period, a predefined temperature differential between the first and second temperatures, or a predefined volume level of refrigerant in interior space 38. For instance, as described above, the time between the closing of inlet and outlet ports 42, 46 may be controlled by adjusting the speed at which storage control body 54 is pushed upward, or by modifying the size and/or location of first and second closure devices 62, 64.

It is also contemplated that electromagnets 68 could be controlled by a microprocessor or other control unit (not shown). The control unit can turn electromagnets 68 on and off, or adjust the strength of electromagnets 68, in response to the refrigerant needs of the system. For instance, control unit may monitor the flow of refrigerant in circuit 12 and determine when additional refrigerant is needed. When additional refrigerant is needed, control unit can initiate electromagnets 68 and/or increase their strength, thus pulling storage body 54 to its dispensing position shown in FIG. D, thereby dispensing additional refrigerant into circuit 12. Control unit may also monitor the system for leaks. When a leak is detected, the control unit can turn off electromagnets 68, thus allowing storage body 54 to move to its closed position as shown in FIG. 2A, thereby containing refrigerant within storage vessel 30.

While this invention has been described as having an exemplary design, the present invention may be further modified within the spirit and scope of this disclosure. This application is therefore intended to cover any variations, uses, or adaptations of the invention using its general principles.

What is claimed is:

1. A vapor compression system for use with a refrigerant, said system comprising:

a closed fluid circuit, said fluid circuit having operably coupled thereto, in serial order, a compressor, a first heat exchanger, an expansion device, a second heat exchanger and a fluid vessel, wherein during operation of said vapor compression system the refrigerant is compressed in said compressor and circulated through said fluid circuit, thermal energy being removed from the refrigerant in said first heat exchanger, the pressure of the refrigerant being reduced in said expansion device, and thermal energy being added to the refrigerant in said second heat exchanger and wherein, upon ceasing operation of said system, liquid phase refrigerant present in said second heat exchanger defines a first temperature and liquid phase refrigerant present in said fluid vessel defines a second temperature, said second temperature being lower than said first temperature, each of said first and second temperatures being less than a temperature of the ambient environment; and a thermal energy storage medium operably coupled to said fluid vessel wherein, upon ceasing operation of said system, said thermal energy storage medium provides said fluid vessel with thermal inertia wherein said second temperature remains cooler than said first temperature as the refrigerant in said second heat exchanger and the refrigerant in said fluid vessel both acquire thermal energy from the ambient environment and refrigerant is attracted to said fluid vessel whereby the mass of refrigerant contained within said fluid vessel increases upon ceasing operation of said system.

2. The vapor compression system of claim 1 wherein said fluid vessel includes an insulating material, said insulating material inhibiting the transfer of thermal energy between refrigerant within said fluid vessel and the ambient environment.

3. The vapor compression system of claim 1 wherein said fluid vessel includes at least one port providing fluid communication between an interior volume of said fluid vessel and said fluid circuit and at least one closure device having an open position allowing passage of refrigerant through said at least one port and a closed position inhibiting the passage of refrigerant through said at least one port.

4. The vapor compression system of claim 1 wherein said fluid vessel defines an interior space for containing refrigerant;

an inlet port providing fluid communication between said fluid circuit and said interior space of said fluid vessel, said inlet port operably disposed in said fluid circuit between said second heat exchanger and said interior space, an outlet port providing fluid communication between said fluid circuit and said interior space of said fluid vessel, said outlet port operably disposed in said fluid circuit between said interior space and said compressor;

a first closure device having an open position allowing communication of refrigerant through said inlet port and a closed position inhibiting communication of refrigerant through said inlet port;

a second closure device having an open position allowing communication of refrigerant through said outlet port and a closed position inhibiting communication of refrigerant through said outlet port; and wherein said first and second closure devices are each in the open position during operation of said system and wherein said second closure device is placed in the closed position substantially contemporaneously with the ceasing of operation of said system, and said first closure device is placed in the closed position within a first time period following the closure of the second closure device.

5. The system of claim 4 wherein said first closure device is placed in a closed position substantially simultaneously with the closure of said second closure device.

6. The system of claim 4 wherein said first temperature is cooler than said second temperature when said first closure device is closed.

7. The system of claim 4 wherein said first closure device is closed when a predefined time period following the closure of said second closure device elapses.

8. The system of claim 4 wherein said first closure device is closed when a differential between said first and second temperatures has become no greater than a predefined temperature differential.

9. The system of claim 4 wherein said first closure device is closed after a predetermined quantity of liquid refrigerant has accumulated in said fluid vessel.

10. The system of claim 4 wherein said first and second closure devices comprise valves disposed proximate said inlet port and said outlet port respectively.

11. The system of claim 4 wherein said first and second closure devices are moveably disposed within said interior space of said fluid vessel.

12. The system of claim 1 wherein said fluid vessel defines an interior space for containing refrigerant and further comprises a storage control device having a selectively displaceable volume wherein liquid phase refrigerant contained within said interior space is dischargeable from said interior space by said storage control device.

13. The system of claim 12 wherein selectively displacing said volume of said storage control device comprises generating a magnetic field to forceably displace said volume.

14. A method of storing refrigerant in a vapor compression system, the vapor compression system including a closed fluid circuit having operably coupled thereto, in serial order, a compressor, a first heat exchanger, an expansion device, and a second heat exchanger, said method comprising:

operably disposing a fluid vessel in the fluid circuit at a location between the second heat exchanger and the compressor;

actively circulating a refrigerant through the fluid circuit wherein thermal energy is removed from the refrigerant in the first heat exchanger and thermal energy being added to the refrigerant in the second heat exchanger;

providing a thermal energy storage device medium operably coupled to the fluid vessel ceasing the active circulation of the refrigerant through the fluid circuit; and upon ceasing active circulation of the refrigerant through the fluid circuit, the thermal energy storage medium providing the storage vessel with thermal inertia such that the refrigerant in the storage vessel is maintained at a lower temperature than the refrigerant in the second heat exchanger as the refrigerant in the storage vessel and in the second heat exchanger acquire thermal energy from the ambient environment to thereby attract refrigerant to the storage vessel so that the mass of refrigerant contained in the storage vessel increases upon cessation of the active circulation of the refrigerant through the fluid circuit.

15. The method of claim 14 wherein the refrigerant is a hydrocarbon refrigerant.

16. A method of storing refrigerant in a vapor compression system, the vapor compression system including a closed fluid circuit having operably coupled thereto, in serial order, a compressor, a first heat exchanger, an expansion device, and a second heat exchanger, said method comprising:

operably disposing a fluid vessel in the fluid circuit at a location between the second heat exchanger and the compressor;

actively circulating a refrigerant through the fluid circuit wherein thermal energy is removed from the refrigerant in the first heat exchanger and thermal energy being added to the refrigerant in the second heat exchanger;

ceasing the active circulation of the refrigerant through the fluid circuit; and attracting refrigerant within the fluid circuit to the fluid vessel after ceasing the active circulation of the refrigerant through the system wherein the mass of refrigerant within the fluid vessel after ceasing the active circulation of the refrigerant through the system is greater than the mass of refrigerant within the fluid vessel immediately preceding the ceasing of the active circulation of the refrigerant through the system;

wherein the fluid vessel includes at least one port providing fluid communication to the fluid circuit and wherein the method further comprises closing the at least one port to contain refrigerant attracted to the fluid vessel after ceasing the active circulation of the refrigerant through the system within the fluid vessel until reinitiating the active circulation of the refrigerant in the fluid circuit.

17. A method of storing refrigerant in a vapor compression system, the vapor compression system including a closed fluid circuit having operably coupled thereto, in serial order, a compressor, a first heat exchanger, an expansion device, and a second heat exchanger, said method comprising:

operably disposing a fluid vessel in the fluid circuit at a location between the second heat exchanger and the compressor;

actively circulating a refrigerant through the fluid circuit wherein thermal energy is removed from the refrigerant in the first heat exchanger and thermal energy being added to the refrigerant in the second heat exchanger;

ceasing the active circulation of the refrigerant through the fluid circuit; and attracting refrigerant within the fluid circuit to the fluid vessel after ceasing the active circulation of the refrigerant through the system wherein the mass of refrigerant within the fluid vessel after ceasing the active circulation of the refrigerant through the system is greater than the mass of refrigerant within the fluid vessel immediately preceding the ceasing of the active circulation of the refrigerant through the system;

wherein the fluid vessel defines an interior space and wherein an inlet port provides fluid communication between the fluid circuit and the interior space of the fluid vessel, the inlet port being operably disposed between the second heat exchanger and the interior space, an outlet port provides fluid communication between the fluid circuit and the interior space of the fluid vessel, the outlet port being operably disposed between the interior space and the compressor, and wherein each of said inlet and outlet ports are closed to contain refrigerant attracted to the fluid vessel after ceasing the active circulation of the refrigerant through the system within the fluid vessel until reinitiating the active circulation of the refrigerant in the fluid circuit.

18. The method of claim 17 wherein said outlet port is closed contemporaneously with the ceasing of the active circulation of the refrigerant through the fluid circuit and said inlet port is closed within a first time period following the closure of the outlet port.

19. The method of claim 17 wherein the refrigerant in the fluid vessel is at a cooler temperature than the refrigerant in the second heat exchanger when the inlet port is closed.

20. The method of claim 17 wherein the inlet port is closed following when a predefined time period following the closure of the outlet port elapses.

21. The method of claim 17 wherein the inlet port is closed when a temperature differential between the refrigerant in the fluid vessel and the second heat exchanger has become no greater than a predefined value.

* * * * *